US006081784A

United States Patent [19]

Tsutsui

[11] Patent Number: 6,081,784

[45] Date of Patent: Jun. 27, 2000

[54] METHODS AND APPARATUS FOR ENCODING, DECODING, ENCRYPTING AND DECRYPTING AN AUDIO SIGNAL, RECORDING MEDIUM THEREFOR, AND METHOD OF TRANSMITTING AN ENCODED ENCRYPTED AUDIO SIGNAL

[75] Inventor: Kyoya Tsutsui, Kanagawa, Japan

[73] Assignee: Sony Corporation, Tokyo, Japan

[21] Appl. No.: 08/958,030

[22] Filed: Oct. 27, 1997

[30] Foreign Application Priority Data

Oct. 30, 1996 [JP] Japan ..... P8-288542

[51] Int. Cl.[7] ..... G10L 21/04

[52] U.S. Cl. ..... 704/501; 704/504; 704/205

[58] Field of Search ..... 704/270, 200, 704/219, 500, 230, 234, 203, 204, 205, 206, 268, 501, 503, 504

[56] References Cited

U.S. PATENT DOCUMENTS

| | | | |
|---|---|---|---|
| 3,808,536 | 4/1974 | Reynolds | 380/45 |
| 4,184,049 | 1/1980 | Crochiere et al. | 179/1 SA |
| 4,535,472 | 8/1985 | Timcik | 381/31 |
| 5,040,217 | 8/1991 | Bradenburg et al. | 381/47 |
| 5,105,463 | 4/1992 | Veldhuis et al. | 381/30 |
| 5,109,417 | 4/1992 | Fielder et al. | 381/36 |
| 5,115,240 | 5/1992 | Fujiwara et al. | 341/51 |
| 5,142,656 | 8/1992 | Fielder et al. | 381/37 |
| 5,264,846 | 11/1993 | Oikawa | 341/76 |
| 5,268,685 | 12/1993 | Fujiwara | 341/76 |
| 5,285,476 | 2/1994 | Akagiri et al. | 375/25 |

(List continued on next page.)

FOREIGN PATENT DOCUMENTS

94/28633 12/1994 WIPO ..... H03M 7/30

OTHER PUBLICATIONS

R. Crochiere et al., "Digital Coding of Speech in Sub–Bands," The Bell System Technical Journal, vol. 55, No. 8, Oct. 1976, pp. 1069–1085.

D.A. Huffman, "A Method for Construction of Minimum Redundancy Codes," Proc. I.R.E., vol. 40, No. 2, Feb. 1952, pp. 1098–1107.

ISO/IEC 11172–3, 1993 (E), International Standard, Information Technology—Coding of Moving Pictures and Associated Audio for Digital Storage Media at up to about 1,5 MBIT/S– Part 3: Audio, pp. 1–150.

M. Krasner, "The Critical Band Coder–Digital Encoding of Speech Signals Based on the Perceptual Requirements of the Auditory System," IEEE Journal, vol. 1–3, Apr. 1980, pp. 327–331.

J. Princen et al., "Subband/Transform Coding Using Filter Bank Designs Based on Time Domain Aliasing Cancellation," ICASSP Apr. 6–9, 1987, vol. 4, pp. 2161–2164.

J.H. Rothweiler, "Polyphase Quadrature Filters—A New Subband Coding Technique," ICASSP 1983 Proceedings, Apr. 1983, vol. 3 of 3, pp. 1280–1283.

R. Zelinski et al., "Adaptive Transform Coding of Speech Signals," IEEE Transactions on Acoustics, Speech, and Signal Processing, vol. ASSP–25, No. 4, Aug. 1977, pp. 299–309.

Application No. 08/837,706, filed Apr. 22, 1997.

*Primary Examiner*—Richemond Dorvil
*Attorney, Agent, or Firm*—Limbach & Limbach L.L.P.

[57] ABSTRACT

An information encoding method for encrypting and encoding information signals, such as PCM audio signals, in which the information signals can be reproduced with low quality even in the absence of the key information for encryption. For carrying out the information encoding method, the input PCM signals are converted by a transform unit into frequency signal components which are encoded by a signal component encoding unit. High frequency range side signal components are sent to an Ex-OR gate to take an Ex-OR of the high frequency range side signal components with a pseudo random bitstring from a pseudo random bitstring generating unit. A codestring generating unit 1606 generates a codestring having the low frequency range side components from a signal component encoding unit and the encrypted high frequency range side components from the Ex-OR gate.

30 Claims, 16 Drawing Sheets

U.S. PATENT DOCUMENTS 5,301,205 4/1994 Tsutsui et al. ..... 375/1
5,357,594 10/1994 Fielder ..... 395/2.2
5,394,473 2/1995 Davidson ..... 381/36
5,406,428 4/1995 Suzuki ..... 360/53
5,414,795 5/1995 Tsutsui et al. ..... 395/2.13
5,438,643 8/1995 Akagiri et al. ..... 395/2.1
5,461,378 10/1995 Shimoyoshi et al. ..... 341/51
5,471,558 11/1995 Tsutsui ..... 395/2.28
5,479,562 12/1995 Fielder et al. ..... 395/2.38
5,490,170 2/1996 Akagiri et al. ..... 375/240
5,581,654 12/1996 Tsutsui ..... 395/2.39
5,617,475 4/1997 Marz ..... 380/14
5,619,570 4/1997 Tsutsui ..... 380/4
5,623,557 4/1997 Shimoyoshi et al. ..... 382/246
5,634,082 5/1997 Shimoyoshi et al. ..... 395/2.38
5,642,379 6/1997 Bremer ..... 375/216
5,717,821 2/1998 Tsutsui et al. ..... 395/2.14
5,724,612 3/1998 Haneda et al. ..... 395/853
5,731,767 3/1998 Tsutsui et al. ..... 341/50
5,737,718 4/1998 Tsutsui ..... 704/205
5,752,224 5/1998 Tsutsui et al. ..... 704/225
5,758,020 5/1998 Tsutsui ..... 395/213
5,758,316 5/1998 Oikawa et al. ..... 704/230
5,778,339 7/1998 Sonohara et al. ..... 704/224
5,781,586 7/1998 Tsutsui ..... 375/241
5,796,695 8/1998 Tsutsui ..... 369/60
5,805,770 9/1998 Tsutsui ..... 395/2.33
5,825,310 10/1998 Tsutsui ..... 341/51
5,825,979 10/1998 Tsutsui et al. ..... 395/2.91
5,832,424 11/1998 Tsutsui ..... 704/206
5,832,426 11/1998 Tsutsui et al. ..... 704/229
5,835,030 11/1998 Tsutsui et al. ..... 341/51
5,835,593 11/1998 Tsutsui ..... 380/23

| A | B | $A \oplus B$ | $A \oplus B \oplus B$ |
|---|---|---|---|
| 0 | 0 | 0 | 0 |
| 0 | 1 | 1 | 0 |
| 1 | 0 | 1 | 1 |
| 1 | 1 | 0 | 1 |

FIG.3

METHODS AND APPARATUS FOR ENCODING, DECODING, ENCRYPTING AND DECRYPTING AN AUDIO SIGNAL, RECORDING MEDIUM THEREFOR, AND METHOD OF TRANSMITTING AN ENCODED ENCRYPTED AUDIO SIGNAL

BACKGROUND OF THE INVENTION

1. Field of the Invention

This invention relates to an information encoding method for encrypting and encoding information signals, such as PCM audio signals, a recording medium having encoded signal recorded thereon, and a decoding device for decoding the encoded signals.

2. Description of the Related Art

There is so far known a method of software circulation in which information signals, such as acoustic signals or video signals, are encrypted for broadcasting or recorded on a recording medium so that only a person who has purchased a key is permitted to view and hear the signals. As a method for encryption, there is known a method of giving a bitstring of PCM acoustic signals an initial value of a random number string as a key signal and to transmit or record on a recording medium a bitstring corresponding to a logical sum of the generated 0/1 random numbers and the above-mentioned PCM bitstring. By using this method, only a person who has acquired the key signal can reproduce the acoustic signals correctly, while another who has not acquired the key signal can reproduce only the noise.

There is also widespread a method of compressing and broadcasting acoustic signals or recording the compressed signals on a recording medium, such that a recording medium capable of recording encoded audio or speech signals thereon, such as a magneto-optical disc, is used extensively. Among the methods for high-efficiency encoding of audio or speech signals, there are a sub-band encoding (SBC) method, which is a non-blocking frequency spectrum splitting method of splitting the time-domain audio signals into plural frequency bands without blocking and encoding the resulting signals of the frequency bands, and a so-called transform coding which is a blocking frequency spectrum splitting method of transforming time-domain signal into frequency domain signals by orthogonal transform and encoding the spectral components from one frequency band to another. There is also known a high-efficiency encoding technique which is a combination of the sub-band coding and transform coding, in which case the time domain signals are split into plural frequency bands by SBC and the resulting band signals are orthogonal transformed into spectral components which are encoded from band to band.

Among the above-mentioned filters is a so-called QMF filter as discussed in 1976, R. E. Crochiere, Digital Coding of Speech in subbands, Bell Syst. Tech. J. Vol.55, No.8, 1976. The technique of dividing the frequency spectrum is discussed in Joseph H. Rothweiler, Polyphase Quadrature Filters—A New Subband Coding Technique, ICASSP 83 BOSTON.

Among the above-mentioned techniques for orthogonal transform is such a technique in which an input audio signal is blocked every pre-set unit time, such as every frame, and discrete Fourier transform (DFT), discrete cosine transform (DCT) or modified DCT (MDCT) is applied to each block for converting the signals from the time axis to the frequency axis. Discussions of the MDCT are found in J. P. Princen and A. B. Bradley, Subband/Transform coding Using Filter Bank Based on Time Domain Aliasing Cancellation, ICASSP 1987.

If the above-mentioned DFT or DCT is used as a method for transforming waveform signals into spectral signals, and transform is applied based on a time block composed of M samples, M independent real-number data are obtained. It is noted that, for reducing junction distortions between time blocks, a given time bock is usually overlapped with M1 samples with both neighboring blocks, and M real-number data on an average are quantized and encoded in DFT or DCT for (M−M1) samples.

On the other hand, if the above-mentioned MDCT is used as a method for orthogonal transform, M independent real-number data are obtained from 2 M samples overlapped with N samples of both neighboring time blocks. Thus, in MDCT, M real-number data on an average are quantized and encoded for M samples. A decoding device adds waveform elements obtained on inverse transform in each block from the codes obtained by MDCT with interference for re-constructing the waveform signals.

In general, if a time block for transform is lengthened, the spectrum frequency resolution is improved such that the signal energy is concentrated in specified frequency components. Therefore, by using MDCT in which, by overlapping with one half of each of both neighboring blocks, transform is carried out with long block lengths, and in which the number of the resulting spectral signals is not increased beyond the number of the original time samples, encoding can be carried out with higher efficiency than if the DFT or DCT is used. Moreover, since the neighboring blocks have sufficiently long overlap with each other, the inter-block distortion of the waveform signals can be reduced.

By quantizing signals split into plural frequency bands by a filter or orthogonal transform, the frequency band in which occurs the quantization noise can be controlled so that encoding can be achieved with psychoacoustic higher efficiency by exploiting acoustic characteristics such as masking effects. If the signal components are normalized with the maximum values of the absolute values of the signal components in the respective bands, encoding can be achieved with a still higher efficiency.

As frequency bands of quantizing the frequency components obtained on splitting the frequency spectrum, it is known to split the frequency spectrum in such a manner as to take account of the psychoacoustic characteristics of the human auditory system. Specifically, the audio signals are divided into a plurality of, such as 25, bands using bandwidths increasing with increasing frequency. These bands are known as critical bands. In encoding the band-based data, encoding is carried out by fixed or adaptive bit allocation on the band basis. In encoding coefficient data obtained by MDCT processing, encoding is by adaptive number of bit allocation for band-based MDCT coefficients obtained by block-based MDCT processing.

As these bit allocation techniques, there are known two techniques described in R. Zelinsky and P. Noll, Adaptive Transform Coding of Speech Signals in 'IEEE Transactions of Acoustics, Speech and Signal Processing, vol. ASSP-25, No.4, August 1977.

In the techniques disclosed in these publications, bit allocation is based on the amplitudes of signals of the respective bands. This technique produces a flat quantization noise spectrum and minimizes the noise energy, but the noise level perceived by the listener is not optimum because the technique does not effectively exploit the psychoacoustic masking effect.

In a publication 'ICASSP 1980, The critical band coder-digital encoding of the perceptual requirements of the auditory system, M. A. Krasner, MIT', the psychoacoustic masking mechanism is used to determine a fixed bit allocation that produces the necessary signal-to-noise ratio for each critical band. However, if this technique is used to measure characteristics of a sine wave input, non-optimum results are obtained because of the fixed allocation of bits among the critical bands.

For overcoming these problems, there is proposed a high-efficiency encoding device in which the total number of bits usable for bit allocation is separately used for a fixed bit allocation pattern pre-fixed from one small black to another and for bit allocation dependent on the signal amplitudes of the respective blocks and the bit number division ratio between the fixed bit allocation and the bit allocation dependent on the signal amplitudes is made dependent on a signal related to an input signal such that the bit number division ratio to the fixed bit allocation becomes larger the smoother the signal spectrum.

This technique significantly improves the signal-to-noise ratio on the whole by allocating more bits to a block including a particular signal spectrum exhibiting concentrated signal energy. Since the human auditory mechanism is sensitive to signals having acute spectral components, not only the measured values are increased, but also the sound quality as perceived by the listener is improved by improving the signal-to-noise ratio characteristics by employing the above technique.

A variety of different bit allocation techniques have been proposed and a model simulating the human auditory mechanism has also been refined such that perceptually higher encoding efficiency can be achieved supposing that the encoding device capability is improved. These techniques in general use a method of finding real-number bit allocation reference value realizing the signal-to-noise ratio characteristics as found by calculations as faithfully as possible and using an integer value approximating the reference value as the number of allocated bits.

In Japanese Laid-Open Patent application 7-500482, there is disclosed a method of separating perceptually critical tonal components, that is signal components having the signal energy concentrated in the vicinity of a specified frequency, from the spectral signals, and encoding these signal components separately from the remaining spectral components. This enables audio signals to be efficiently encoded with a high compression ratio without substantially deteriorating the psychoacoustic sound quality.

In constructing an actual codestring, it suffices to encode the quantization fineness information and the normalization coefficient information with pre-set numbers of bits from one area for normalization and quantization to another and to encode the normalized and quantized spectral signals.

In the high-efficiency encoding system in which the number of bits specifying the quantization fineness information differs with the frequency bands, as disclosed in MPEG standard ISO/IEC 11172-3:1993 (E), 1993. The standard is set so that the number of quantization bits specifying the quantization fineness information is decreased with increasing frequency.

There is also known a method of determining the quantization fineness information from the normalization coefficient information in a decoding device instead of directly encoding the quantization fineness information. Since the relation between the normalization coefficient information and the quantization fineness information is set at a time point of setting the standard, it becomes impossible to introduce quantization fineness which is based on a more advanced perceptual model in future. Moreover, if there is a certain width in the compression ratio to be realized, it becomes necessary to set the relation between the normalization coefficient information and the quantization fineness information from one compression ratio to another.

There is also known a method of encoding quantized spectral signals using a variable length codes discussed in D. A. Huffman: 'A Method for Construction of Minimum Redundancy Codes, Proc. I.R.E., 40, p.1098 (1952) for realizing more efficient encoding.

The signals encoded as described above can also be encrypted and circulated as in the case of the PCM signals. In this case, a person who has not acquired key signals cannot reproduce original signals. There is also a method of converting the PCM signals into random signals for compression encoding instead of encrypting the coded bitstring. In this case, too, a person who has not acquired key signals cannot reproduce any other signal than noise.

With these scrambling methods, the original signals reproduced in the absence of the key signals or by a usual reproducing means become noise such that the contents of the software cannot be understood. The result is that the scrambling methods cannot be used for the purpose of distributing a disc having recorded thereon the music with lower sound quality for allowing a hearer to purchase the key only for music pieces that meets his or her taste to reproduce the same music piece with high sound quality, or allowing the hearer to tentatively hear the music software piece before newly purchasing a disc having recorded thereon the same music piece with high sound quality.

Moreover, it has so far been difficult to encrypt the high-efficiency encoded signals to evade lowering of the compression efficiency despite the fact that the codestring as given is meaningful for usual reproducing means. That is, if a codestring obtained on high-efficiency encoding is scrambled, not only is the noise produced on reproduction of the codestring, but also the reproducing means occasionally cannot operate if the codestring obtained on scrambling is not in meeting with the standard for the original high-efficiency encoded signals.

Conversely, if, when the PCM signals are high-efficiency encoded prior to scrambling, the information volume is diminished by exploiting, for example, the psychoacoustic characteristics of the human auditory system, the scrambled PCM signals cannot necessarily be reproduced at a time point of decoding the high-efficiency encoded signals to render it difficult to descramble the signals correctly. Thus it has been necessary to select a compression method which enables correct descrambling despite the lowered efficiency

SUMMARY OF THE INVENTION

It is therefore an object of the present invention to provide an information encoding method, a recording medium and a decoding device for decoding the encoded signals in which, in encrypting and sending information signals, such as audio or video signals, or recording the signals on a recording medium, reproduction with low sound quality barely permitting the signal contents to be recognized is rendered possible even in the absence of the encryption key, and in which reproduction with a high sound quality is enabled by using the key.

In one aspect, the present invention provides an information encoding method including the steps of splitting an input information signal into a first signal component permitting only comprehension of its contents and a second signal component for high quality reproduction, and encrypting and encoding only the second signal component.

That is, an input signal is split into a first signal component of low quality barely permitting comprehension of signal contents and a second signal component for high quality reproduction, the first signal component is adapted to be reproducible even by a reproducing unit devoid of a decrypting function such as descrambling function, and a reproducing unit receiving a key for decoding can reproduce the first signal component along with the second signal component for enabling high quality reproduction.

The present invention is applicable to a recording medium having the encoded signals recorded thereon.

In another aspect, the present invention provides a decoding apparatus fed with an encoded signal, as an input information signal, which is split into a first signal component of low quality permitting only comprehension of the signal contents and a second signal component for high quality reproduction, wherein whether or not the second signal component of the encoded signal should be decoded is set depending on the presence or absence of a key signal for encryption.

Preferably, the encoding is the encoding by compression. Also preferably, part of the information is encoded in duplex into a first code for low quality reproduction and into a second code for high quality reproduction, with the first code not being encrypted. The part of the information may be the information concerning the second signal component, while the signal is an acoustic signal.

Also, in the present invention, the signal is high-efficiency encoded and subsequently encrypted. Since the codestring formulated in this manner is a meaningful codestring for reproducing means devoid of a key, reproduction of lower quality by a wide range of reproducing devices becomes possible.

According to the present invention, in which an input information signal is split into a first signal component permitting only comprehension of its contents and a second signal component for high quality reproduction and only the second signal component is encrypted and encoded, low quality reproduction barely permitting comprehension of the signal contents can be realized even in the absence of the key information used for encryption, while high quality reproduction becomes possible with the use of the key information.

Thus it has become possible to judge after confirming the software contents whether the key information required for high quality reproduction should be purchased, thus enabling smoother software distribution. Moreover, low quality reproduction permitting comprehension of the contents of a music number can be realized with a usual reproducing device, so that the contents of the music number can be tentatively heard using the usual reproducing device during, for example, the time of commutation, so that a larger number of persons tentatively hear the music number to decide whether or not a disc having the musical number of the same contents can be purchased. Also, with the method of the present invention, the encryption realizing the above objective becomes possible in case of high-efficiency encoding.

In addition, part of the information is encoded in duplex into a first code for low quality reproduction and a second code for high quality reproduction and the first code is not encrypted, so that, by using the first code for reproduction, low-quality reproduction can be achieved without averse effect, such as noise, caused by the second signal component. Since the codestring can be made a meaningful codestring for reproducing means devoid of a key, reproduction of lower quality becomes possible on a wide range of reproducing devices.

BRIEF DESCRIPTION OF THE DRAWINGS

FIG. 3 illustrates a method for encryption and decoding.

DESCRIPTION OF THE PREFERRED EMBODIMENTS

Figure 1:
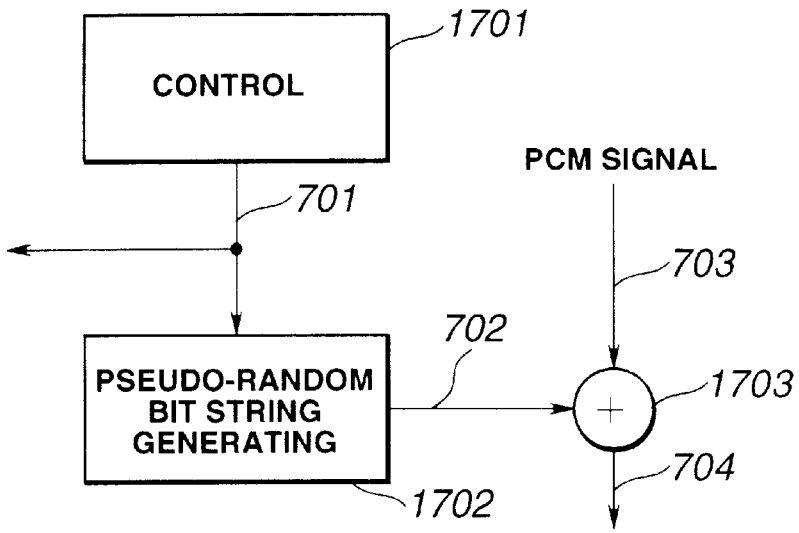
FIG. 1 is a block diagram showing an example of a structure for encrypting information signals.

Referring to the drawings, preferred embodiments of an information encoding method, a recording medium and a decoding device according to the present invention will be explained in detail.

The encoding technique employed in the present invention is first explained with reference to FIGS. 1 to 3.

FIG. 1 shows a block diagram showing an illustrative structure for generating an encrypted bitstring. The present encrypting device sends each bit of a PCM signal 703 as an input information signal to an Ex-OR gate 1703 in order to take an Ex-OR thereof with an output 702 of a pseudo random bitstring generating unit 1702 generated by exploiting the initial value information 701 sent from a control unit 1701 to output a bitstring 704. The pseudo random bitstring generating unit 1702 may be constructed so that an optionally selected 100-bit bitstring as an initial value is multiplied by itself to give another bitstring the mid 100 bits only of which are left to form a new bitstring. This sequence of operations is repeated to form further new bitstrings the $50^{th}$ bits from the lower sides of which are then selected to form a string of random numbers. The resulting output bit string is recorded on, for example, an optical disc so that only a person who has acquired the correct key, herein the initial value information, can reproduce the original PCM signals.

Figure 2:
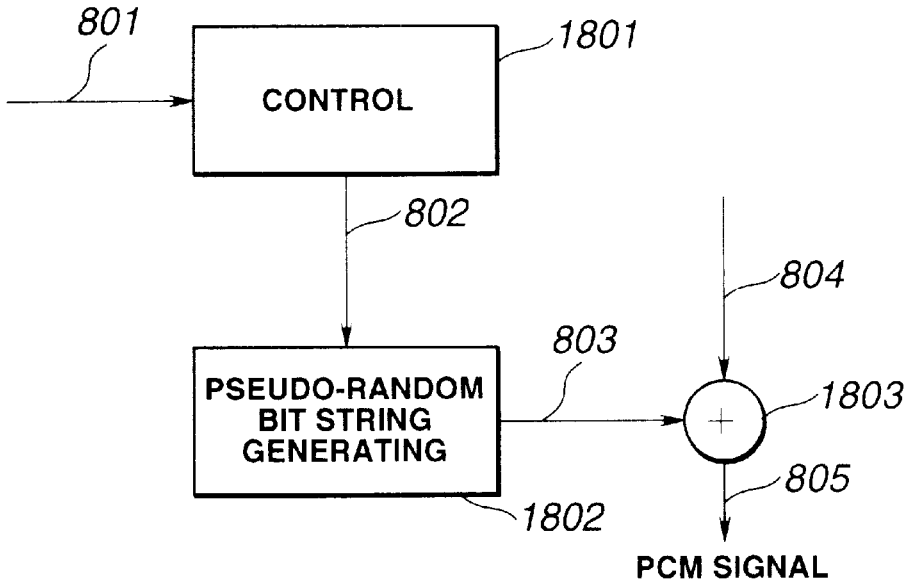
FIG. 2 is a block diagram showing an example of a structure for decoding a codestring obtained on encrypting information signals.

FIG. 2 shows an illustrative structure of a decoding device for decoding the bitstring 704 outputted by the encrypting device of FIG. 1. A pseudo random bitstring generating unit 1802 has the same function as the first pseudo random bitstring generating unit 1702 so that, if the same key signal is supplied as an initial value, the pseudo random bitstring generating unit 1802 produces the same pseudo random bitstring 803. This pseudo random bitstring 803 is Ex-ORed with the input signal 804. Referring to FIG. 3, if a bit A is Ex-ORed twice with a bit B, the bit A is regenerated. Therefore, if the correct key signal is on hand, a bitstring 805 can be correctly reproduced. In the example of FIG. 2, the key information 801 is supplied to a control unit 1801, which sends to the pseudo random bitstring generating unit 1802 the same initial value information 802 as the initial value information 701 from the control unit 1701 of FIG. 1 to cause the pseudo random bitstring generating unit 1802 to produce the same pseudo random bitstring as that for encryption to send the pseudo random bitstring thus generated to an Ex-OR gate 1803.

However, if the above-mentioned encryption is done on the whole on the PCM signal; as an input information signal, the contents of the software recorded on the recording medium, such as a disc, cannot be known, so that a person who has procured a disc cannot give a decision as to whether or not the key signal for decoding it should be purchased. Thus it has not been possible to distribute software at a reduced cost and to permit a user who heard the software tentatively and has become fond of it to purchase the key signal.

For overcoming this inconvenience, the PCM signal, as an input information signal, is divided, according to an embodiment of the present invention, into two signal components, only one of which is encrypted and encoded. For example, only the low frequency range components of the input PCM signal, as the second signal components, are encrypted, with the low frequency range components of the input PCM signal being then the first signal components.

Figure 4:
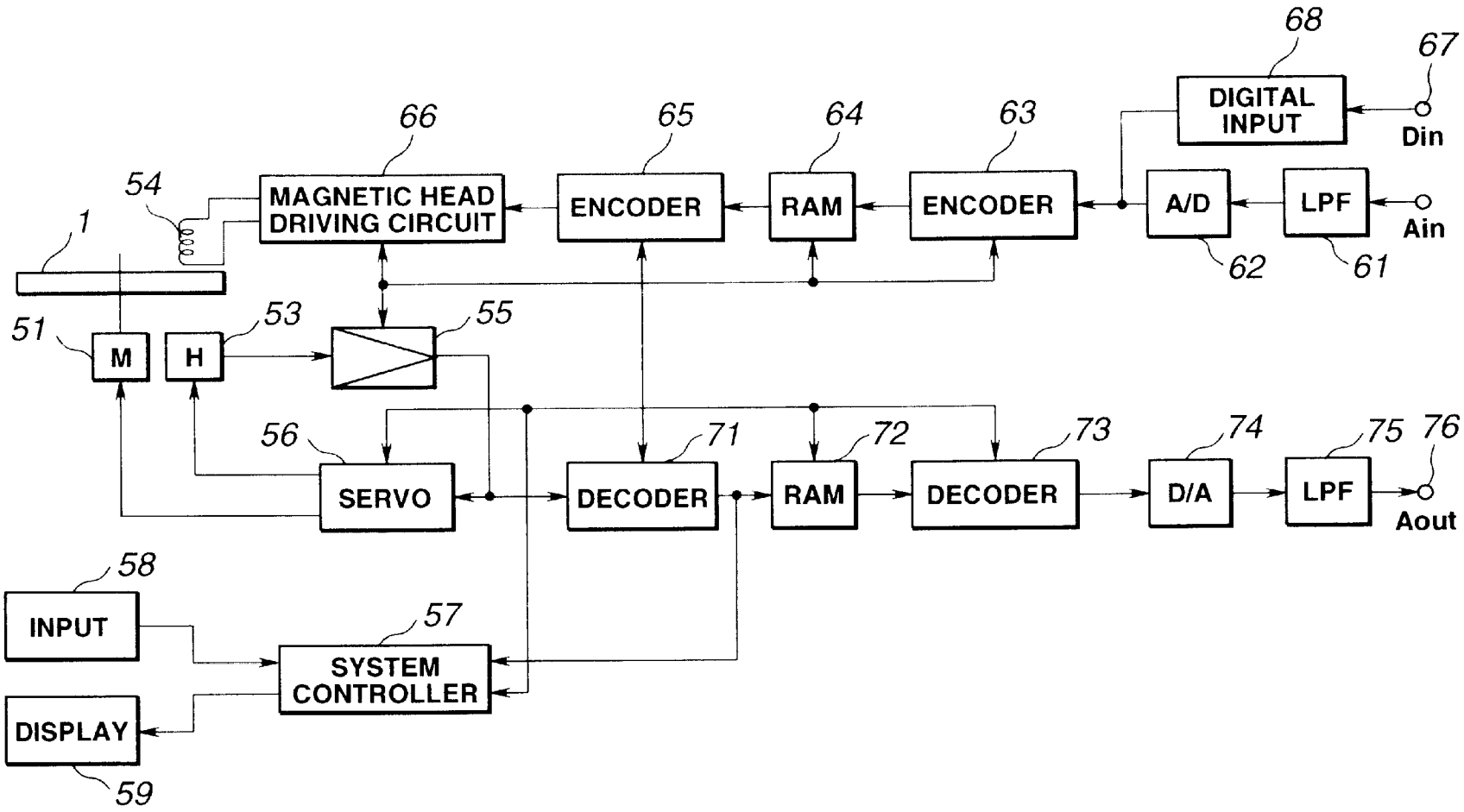
FIG. 4 is a schematic block circuit diagram showing a structure of a compressed data recording and/or reproducing device embodying the present invention.

Referring to FIG. 4, an example of a compressed data recording and/or reproducing device, embodying the present invention, is hereinafter explained.

In the compressed data recording and/or reproducing device, shown in FIG. 4, a magneto-optical disc 1, run in rotation by a spindle motor 51, is used as a recording medium. For recording data on the magneto-optical disc 1, a magnetic field modulated in accordance with recording data is applied to the magneto-optical disc 1 by a magnetic head 54, whilst a laser light beam is illuminated by an optical head 53 thereon, by way of magnetic field modulation recording, for recording data on a recording track of the magneto-optical disc 1. For reproduction, the recording track of the magneto-optical disc 1 is traced with the laser light beam by the optical head 53 for photomagnetically reproducing the data.

The optical head 53 is made up of optical components, such as a laser light source, for example, a laser diode, a collimator lens, an objective lens, a polarization beam splitter or a cylindrical lens and a photodetector having a pre-set pattern. For recording data on the magneto-optical disc 1, the magnetic head 54 is driven by a head driving circuit 66 of a recording system, as later explained, for impressing a modulation magnetic field corresponding to the recording data, and the laser light beam is illuminated on a target track of the magneto-optical disc 1 for thermomagnetic recording in accordance with the magnetic field modulation system. The optical head 53 also detects the reflected laser light from the target track for detecting the focusing error and the tracking error by the astigmatic method and by the push-pull method, respectively. For reproducing the focusing error and the tracking error, the optical disc 53 detects the focusing error and the tracking error, while simultaneously detecting the difference in the polarization angle (Kerr rotation angle) of the reflected laser light from the target track for generating the playback signals.

An output of the optical head 53 is supplied to an RF circuit 55 which extracts the focusing error signals and the tracking error signals from the output of the optical head 53 to supply the extracted signals to a servo control circuit 56, while converting the playback signals to a bi-level signal which is supplied to a decoder 71 of the reproducing system.

The servo control circuit 56 is made up of, for example, a focusing servo control circuit, a tracking servo control circuit, a spindle motor servo control circuit and a thread servo control circuit. The focusing servo control circuit controls the optical system of the optical head 53 for reducing the focusing error signals to zero, while the tracking servo control circuit controls the optical system of the optical head 53 for reducing the tracking error signals to zero. The spindle motor servo control circuit controls the spindle motor 51 so that the magneto-optical disc 1 will be run in rotation at a pre-set rotational velocity, such as at a pre-set linear velocity. The thread servo control circuit also moves the optical head 53 and the magnetic head 54 to a target track position on the magneto-optical disc 1 designated by a system controller 57. The servo control circuit 56, performing these various control operations, sends the information specifying the operating states of the various components controlled by the servo control circuit 56 to the system controller 57.

To the system controller 57 are connected a key input operating unit 58 and a display unit 59. The system controller 57 supervises the recording system and the reproducing system by the operating input information from the key input unit 58. The system controller 57 also supervises the recording position or the playback position on the recording track traced by the optical head 53 and the magnetic head 54, based on the sector-based address information reproduced by the header timer or subcode Q-data from the recording track of the magneto-optical disc 1. The system controller 57 also performs control of displaying the playback time on the display unit 59 based on the data compression rate of the compressed data recording/reproducing device and the playback position information on the recording track.

For playback time display, the sector-based address information (absolute time information) reproduced by the header data or the sub-code Q data from the recording track of the magneto-optical disc 1 is multiplied by a reciprocal of the data compression ratio, such as 4 for the 1/4 compression, in order to find the actual time information, which is displayed on a display unit 59. For recording, if the absolute time information is pre-recorded (pre-formatted) on the recording track of, for example, a magneto-optical disc, the pre-formatted absolute time information can be read out and multiplied by the reciprocal of the data compression ratio for displaying the current position in terms of the actual recording time.

In a recording system of the disc recording/reproducing device, shown in FIG. 4, an analog audio input signal $A_{in}$ at an input terminal 60 is supplied via a low-pass filter 61 to an A/D converter 62 which then quantizes the analog audio input signal $A_{in}$. The digital audio input signal $D_{in}$ form the input terminal 67 is supplied via a digital input interfacing circuit 68 to the ATC encoder 63. The ATC encoder 63 performs bit compression (data compression) corresponding to a pre-set data compression ratio on the digital audio PCM data of the pre-set transfer rate obtained on quantization of the input signal $A_{in}$ by the A/D converter 62. The compressed data (ATC data) output by the pre-set data compression ratio is supplied to a memory 64. Supposing that the data compression ratio is 1/8, the data transfer rate is reduced to one-eighth of the data transfer rate of the CD-DA format as the standard digital audio CD format of 75 sectors/sec or to 9.375 sectors/second.

The memory (RAM) 64 is used as a buffer memory having data write/readout controlled by the system controller 57 and which is configured for transiently holding the ATC data supplied from the ATC encoder 63 for recording the data on a disc whenever the necessity arises. That is, if the data compression ratio is 1/8, for example, the compressed audio data supplied from the ATC encoder 63 has its data transfer rate reduced to 1/8 of the data transfer rate for the standard CD-DA format of 75 sectors/second, that is to 9.375 sectors/second. It is these compressed data (ATC data) that is continuously recorded in the memory 64. For these compressed data (ATC data), it suffices to record the data at a rate of one sector per eight sectors, as discussed previously. However, since this recording every eight sectors is virtually impossible, sector-continuous recording is carried out, as will be explained subsequently.

This recording is carried out in a burst fashion at the same data transfer rate as that for the standard CD-DA format (75 sectors/second), with a preset plural sectors, such as 32 sectors plus several sectors, as a recording unit. That is, the ATC audio data with the data compression rate of 1/8, continuously written at a low transfer rate of 9.375 (+75/8) sectors/second, are read out in a burst-like manner as recording data at the above-mentioned transfer rate of 75 sectors/second. The overall data transfer rate of the data, thus read out and recorded, including the non-recording period, is the above-mentioned low rate of 9.375 sectors/second. However, the instantaneous data transfer rate within the time of the burst-like recording operation is the above-mentioned standard rate of 75 sectors/second. Therefore, if the rotational velocity of the disc is the above-mentioned standard velocity of the CD-DA format (constant linear velocity), recording is by the same recording density and the same recording pattern as those of the CD-DA format.

The ATC audio data, that is the recording data, read out from the memory 64 in the burst-like manner at the (instantaneous) transfer rate of 75 sectors/second, is supplied to an encoder 65. In the data string supplied from the memory 64 to the encoder 65, a continuous recording unit per each recording is a cluster made up of plural sectors, such as 32 sectors, and several cluster-interconnecting sectors arrayed ahead and at back of the cluster. These cluster interconnecting sectors are set so as to be longer than the interleaving length at the encoder 65, such that data of other clusters is not affected by interleaving.

The encoder 65 applies encoding for error correction, such as parity appendage and interleaving, or EFM encoding, on the recording data supplied in a burst-like fashion from the memory 64. The recording data encoded by the encoder 65 are supplied to a magnetic head driving circuit 66. To this magnetic head driving circuit 66 is connected the magnetic head 54 so that the magnetic head 54 is driven for impressing the magnetic field modulated in accordance with the recording data is impressed across the magneto-optical disc 1.

The system controller 57 performs memory control as described above on the memory 64, while also controlling the recording position for continuously recording the recording data continuously in a burst-like manner from the memory 64 by this memory control on the recording track of the magneto-optical disc 1. For controlling the recording position in this manner, the recording position read out in a burst fashion from the memory 64 is supervised by the system controller 57 for supplying a control signal designating the recording position on the recording track of the magneto-optical disc 1 to the servo control circuit 56.

The reproducing system of the disc recording/reproducing device shown in FIG. 4 is explained. This reproducing system is configured for reproducing recording data continuously recorded on the recording track of the magneto-optical disc 1 by the above-described recording system. Thus, the reproducing system includes a decoder 71 supplied with a bi-level signal obtained by an RF circuit 55 from the playback output obtained in turn by the optical head 53 tracing the recording track of the magneto-optical disc 1 with a laser light beam. At this time, not only the magneto-optical disc but also the read-only optical disc similar to the compact disc (CD) can be read.

The decoder 71 is a counterpart device of the encoder 65 of the above-described recording system. The playback output, converted into the bi-level signal by the RF circuit 55, is decoded for error correction or EFM decoded for reproducing the ATC audio data having the data compression rate of 1/8 at a transfer rate of 75 sectors/second, which is faster than the normal transfer rate. The playback data, obtained by the decoder 71, is supplied to a memory 72.

In the memory (RAM) 72, having data write/readout controlled by the system controller 57, the playback data supplied from the decoder 71 at the transfer rate of 75 sectors/second, is written in a burst-like manner at the transfer rate of 75 sectors/second. In the memory 72, the above-mentioned playback data, written at the above-mentioned transfer rate of 75 sectors/second, is continuously read out at the transfer rate of 9.375 sectors/second corresponding to the data compression rate of 1/8.

The system controller 57 performs memory control for writing the playback data in the memory 72 at the transfer rate of 75 sectors/second, while reading out the playback data from the memory 7 at the transfer rate of 9.375 sectors/second. The system controller 57, performing the memory control for the memory 72 as described above, controls the playback position for continuously reading out the playback data written in the burst-like manner from the memory 72 by the memory control from the recording track of the magneto-optical disc 1. The playback position control is by supervising the playback position of the playback data read out in the burst-like manner from the memory 72 by the system controller 57 for supplying a control signal designating the playback position on the recording track of the optical disc 1 or the magneto-optical disc 1 to the servo control circuit 56.

The ATC audio data, continuously read out from the memory 72 at the transfer rate of 9.375 sectors/second is supplied to an ATC decoder 73. This ATC decoder 73 is a counterpart device of the ATC encoder 63 of the recording system and reproduces the 16-bit digital audio data by expanding the ATC data by a factor of eight. The digital audio data from the ATC decoder 73 is supplied to a D/A converter 74.

The D/A converter 74 converts the digital audio date supplied from the ATC decoder 73 into analog signals for forming an analog audio output signal $A_{out}$. This analog audio output signal $A_{out}$, obtained from the D/A converter 74, is outputted via a low-pass filter 75 at an output terminal 76.

The high-efficiency encoding is explained in detail. Specifically, the technique of high-efficiency encoding the input digital signal of the audio PCM signal by techniques of sub-band coding (SBC), adaptive transform coding (ATC) and adaptive bit allocation is explained by referring to FIG. 5 ff.

Figure 5:
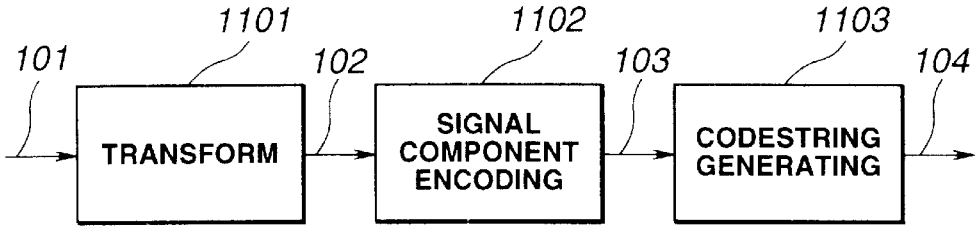
FIG. 5 is a block diagram showing an example of an encoding device for illustrating the present invention.

FIG. 5 shows a schematic block diagram showing the structure of an acoustic waveform signal embodying the present invention. In the instant embodiment, the input waveform signals are converted by a transform unit 1101 into a signal 102 of signal frequency components each of which is encoded by a signal component encoding unit 1102 into a signal 103 from which a codestring 104 is generated by a codestring generating unit 1103.

Figure 6:
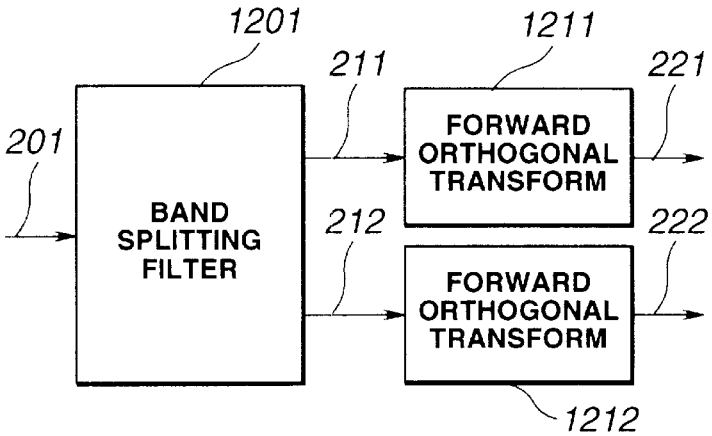
FIG. 6 is a block diagram showing an illustrative example of conversion means of the encoding device shown in FIG. 5.

FIG. 6 shows a specified example of the transform unit 1101 of FIG. 5. An input signal 201 is split by a band splitting filter into two frequency bands and transformed in each band into spectral signal components 221, 222 by forward orthogonal transform units 1211, 1212 such as by a MDCT. The input signal 201 of FIG. 6 corresponds to the signal 102 of FIG. 5, while signals 221, 222 of FIG. 6 correspond to the signal 102 of FIG. 5. The transform unit of FIG. 6 reduces the bandwidths of the signals 211, 212 by one-half of the bandwidth of the signal 201, that is the bandwidths of the signals 211, 212 are diminished to one-half that of the signal 201. Of course, various other transform means other than the transform unit of FIG. 6 may be used. For example, the input signal may be directly transformed by MDCT into spectral signals, while the input signal may also be transformed by discrete Fourier transform (DFT) or discrete cosine transform (DCT). Although the input signal may be split into frequency components by a band splitting filter, the input signal is preferably transformed by the above-mentioned orthogonal transform methods into frequency components because then a large number of frequency components can be obtained with a smaller volume of processing operations.

Figure 7:
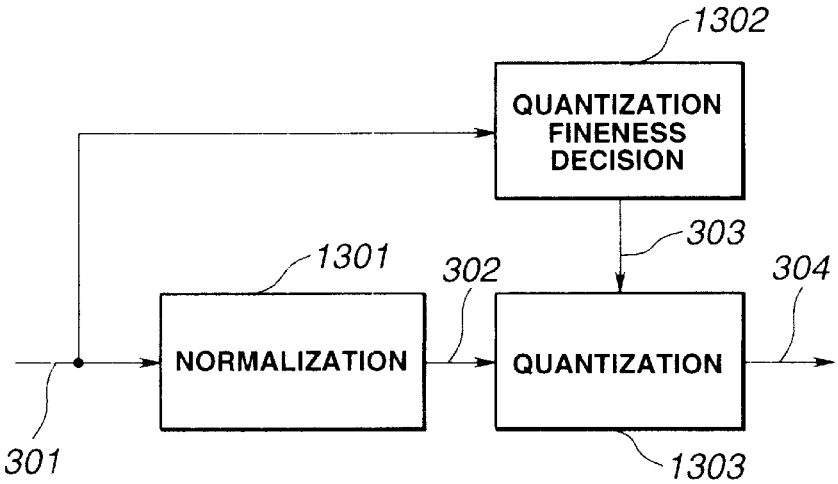
FIG. 7 is a block diagram showing an illustrative example of encoding means for encoding signal components of the encoding device shown in FIG. 5.

FIG. 7 shows a specific embodiment of the signal component encoding unit 1102 of FIG. 5. The signal components are normalized by a normalization unit 1301 from one pre-set band to another to form a signal 302 which is then quantized by a quantization unit 1303 based on the quantization fineness (signal 303) calculated by a quantization fineness calculating unit 1302 so as to be outputted as a signal 304. The signals 301 and 304 of FIG. 7 correspond to the signals 102 and 103 of FIG. 5, respectively. The signal 304, shown herein, now contains the normalization coefficient information and the quantization fineness information in addition to the quantized signal components.

Figure 8:
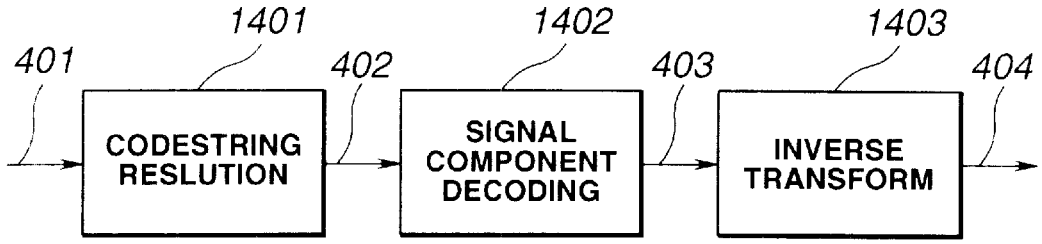
FIG. 8 is a block diagram showing an illustrative example of a decoding device for illustrating the present invention.

FIG. 8 shows a block diagram illustrating an example of a decoding device outputting acoustic signals from a codestring generated by the encoding device shown in FIG. 5. In the decoding device shown in FIG. 8, signal components 402 are extracted from the signal 401 by a codestring resolution unit 1401 and, from these signal components 402, signal components 403 are restored by a signal decoding unit 403 to output acoustic waveform signals by an inverse transform unit 1403.

Figure 9:
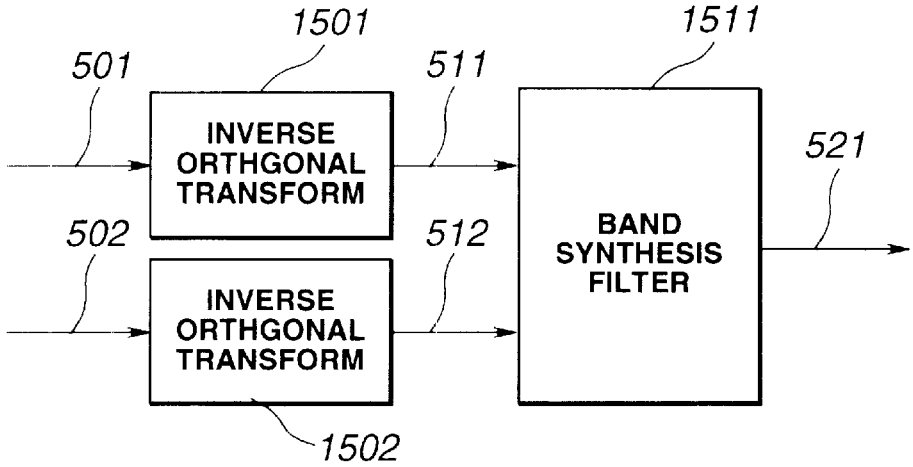
FIG. 9 is a block diagram showing an illustrative example of back-conversion means for the decoding device shown in FIG. 8.

FIG. 9 shows a specified example of the inverse transform unit 1403 of FIG. 8. In this example, corresponding to the specified example of the transform unit of FIG. 6, signals of respective bands 511, 512 obtained by the inverse orthogonal transform units 1501, 1502 are synthesized by a band-synthesis filter 1511. The signals 501, 502 correspond to the signal 403 of FIG. 8, while the signal 521 of FIG. 9 corresponds to the signal 404 of FIG. 8.

Figure 10:
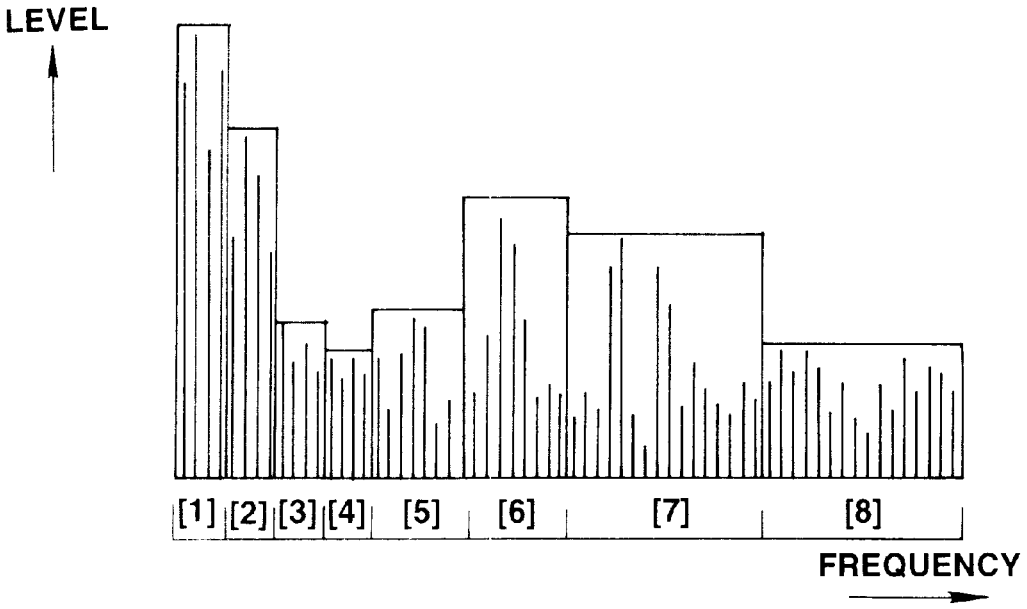
FIG. 10 illustrates spectral signs of an encoding method for illustrating the present invention.

FIG. 10 illustrates the conventional encoding method used so far in the encoding device shown in FIG. 5. In the example of FIG. 10, the spectral signals are obtained by the transform unit of FIG. 6. FIG. 10 shows absolute values of the spectral components of MDCT in dB. The input signal is transformed into 64 spectral signals in terms of a pre-set time block as a unit and the spectral signals are normalized and quantized in eight bands 1 to 8, termed herein as encoding units. The quantization fineness can be varied from one encoding unit to another depending on the manner of distribution of the frequency components for assuring psychoacoustically efficient encoding in which sound quality deterioration can be suppressed to a minimum.

The encoding efficiency can be improved further than is possible with the above-mentioned methods. For example, the encoding efficiency can be improved by allocating a shorter code length to quantized spectral signals of a higher probability of occurrence, and by allocating a longer code length to quantized spectral signals of a lower probability of occurrence. Alternatively, the quantity of the subsidiary information such as the quantization fineness information or the normalization coefficient information can be relatively reduced, while the frequency resolution can be improved, by using a longer transform block length, thus enabling more intricate control of the quantization fineness on the frequency axis thus improving the encoding efficiency.

Figure 11:
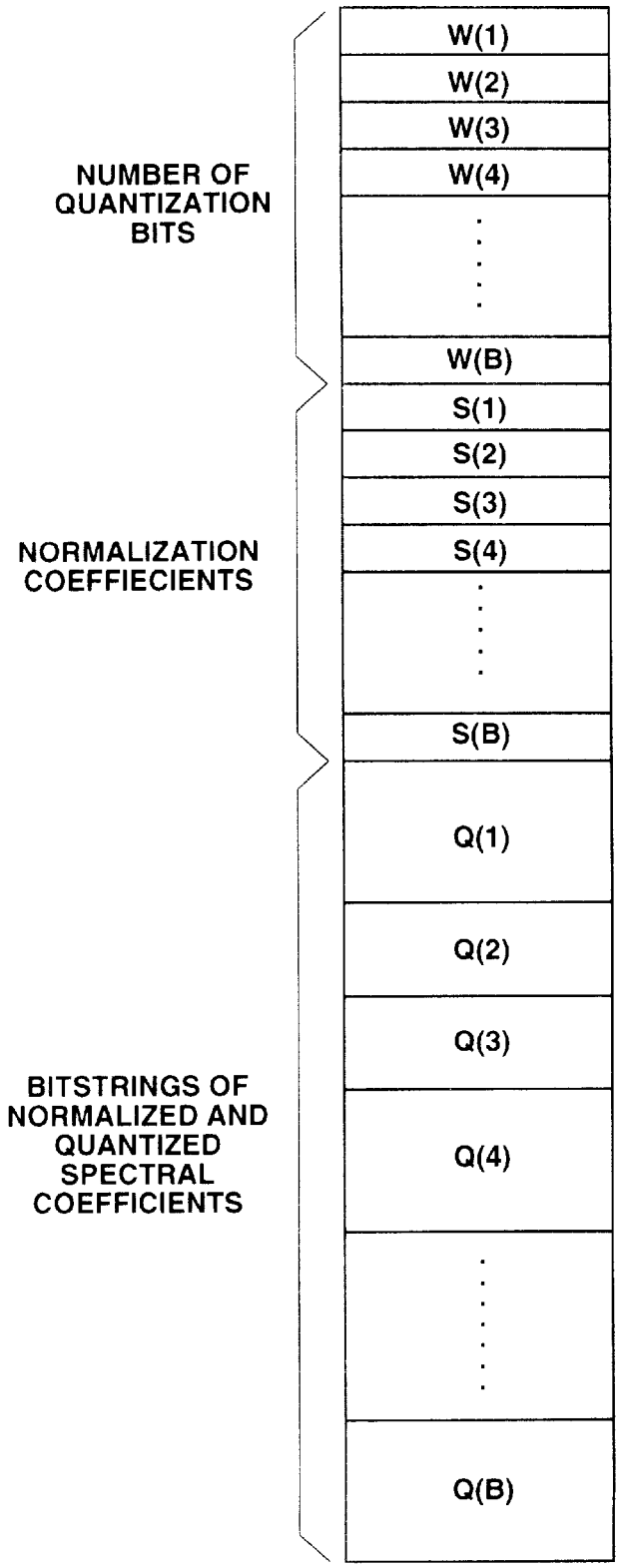
FIG. 11 illustrates an example of a codestring obtained by the encoding method for illustrating the present invention.

FIG. 11 shows an embodiment of the format which is based on the prior-art technique of recording a signal encoded by the above-mentioned method. In the present embodiment, the entire spectrum is split into B bands. The number of quantization bits of the ith band W(i), the normalization coefficients S(i) and the bit string Q(i) of normalized and quantized spectral coefficients of the ith band W(i) as counted from the low frequency range side, where $1 \leqq i \leqq B$, are recorded in the sequence shown in FIG. 11.

Figure 12:
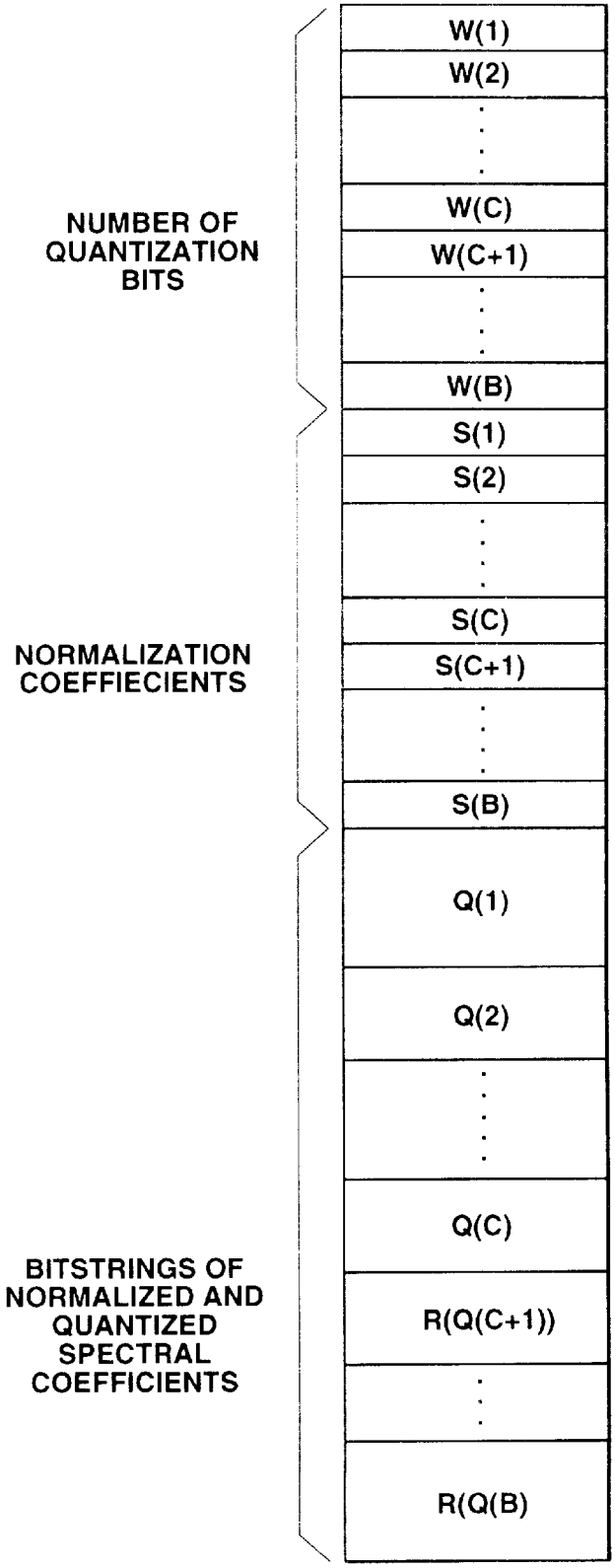
FIG. 12 illustrates an example of a codestring obtained by an encoding method according to an embodiment of the present invention.

In the first embodiment of the present invention, part of the signal components permitting the contents of a software to be confirmed are not encrypted, such that the contents thereof can be viewed or heard by usual reproducing means, while signal components enabling reproduction with higher sound quality are encrypted and recorded so that only the person who has acquired a key can reproduce the signal with high valuable signal quality and hence can reproduce the signal with a high signal quality. FIG. 12 shows an example of a codestring in case of encoding by the method of a first embodiment of the present invention.

Specifically, in the embodiment of FIG. 12, the input information signal is split into a low frequency range component as a first signal component of low quality barely allowing comprehension of the contents and a high frequency range component as a second signal component permitting signal reproduction with a higher signal quality, and only the second signal component is encrypted and encoded.

The codestring of FIG. 12 differs from the codestring of FIG. 11 only in that Q(c+1) to Q(B) corresponding to the high frequency range components of the input information signal, where 1<C<B, are encrypted by a pseudo random bitstring and encoded as a codestring of from R(Q(c+1)) to R(Q(B)).

If it is attempted to reproduce this codestring by a decoding device shown in FIG. 8, the high frequency range signals of from (C+1) to B cannot be reproduced correctly because of encrypted separate rows of the normalized and quantized spectral coefficients. However, the low frequency range signals of from the first to Cth bands can be decoded correctly. In acoustic signals in general, the major portion of the information volume is concentrated in the low frequency range signal. Thus, if the low frequency range side signal is reproduced correctly in this manner, the test viewer can comprehend the contents of the software, so that he or she can judge whether or not the key necessary for high sound quality reproduction should be purchased.

Figure 13:
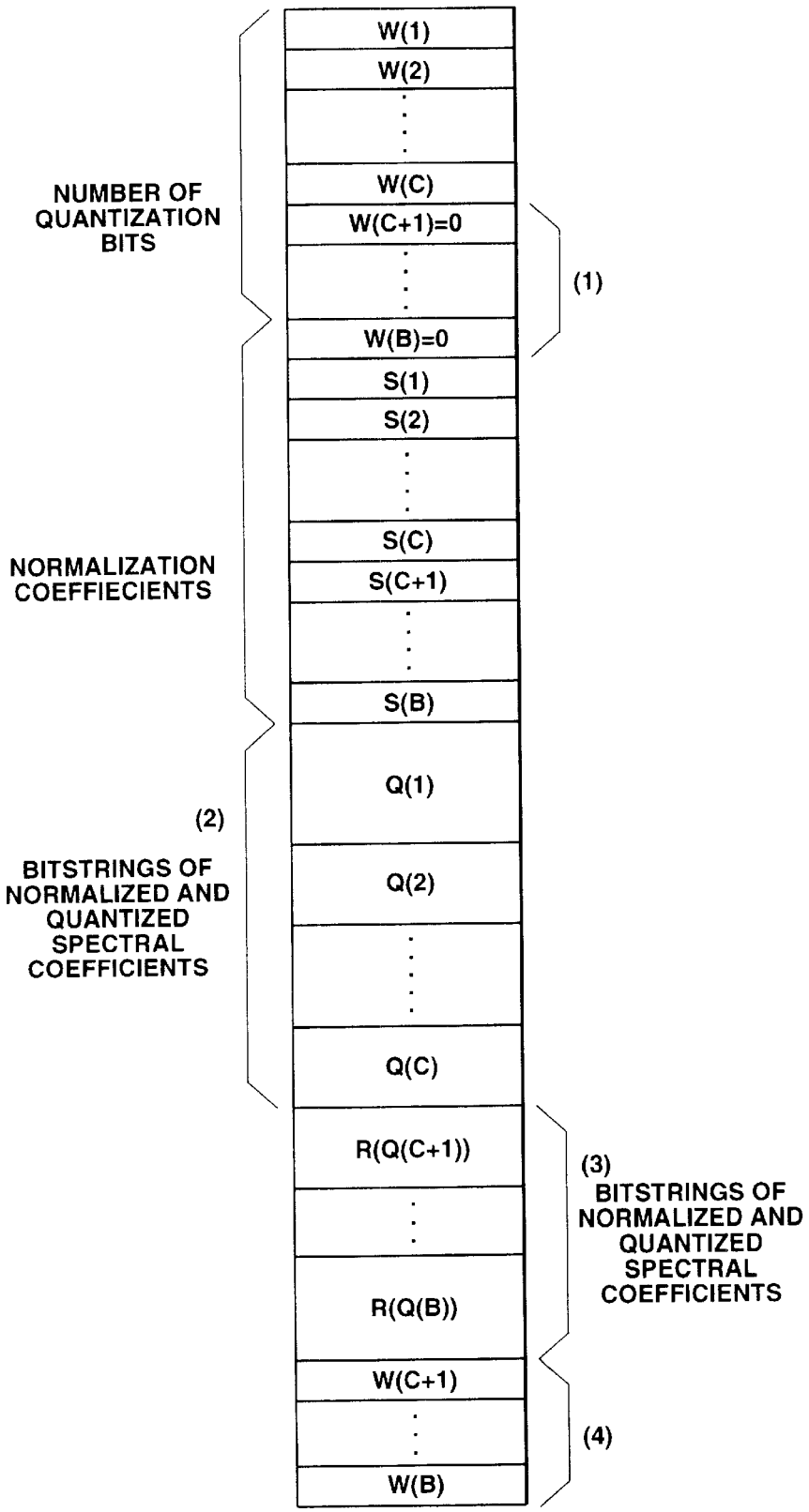
FIG. 13 illustrates an example of a codestring obtained by an encoding method according to another embodiment of the present invention.

Meanwhile, if the encoding method of FIG. 12 is used, and it is attempted to reproduce the signal by the decoding device of FIG. 8, there is left a disagreeable noise on the high frequency range side. Referring to FIG. 13, an encoding method according to a more desirable embodiment of the present invention is explained for obviating the defect.

In the embodiment of FIG. 13, there is recorded, in the portion of the bitstring of FIG. 12 where the signals of from W(C+1) to W(B) have been recorded, information specifying that 0 bits have been allocated as W'(C+1) to W'(B), while the signals of from W(C+1) to W(B) are recorded in the trailing end of this block signal. The encoding in the embodiment of FIG. 13 is done on the assumption that the number of bits used by the bitstring of the normalized and quantized spectral coefficients is smaller than in the example of FIG. 12 by a codestring portion required for recording the signals of from W(C+1) to W(B).

That is, in the embodiment shown in FIG. 13, the input information signal is divided into the low frequency range component barely allowing comprehension of the contents and high frequency range component for high quality reproduction, and only the high frequency range component is encrypted and encoded as a codestring portion of from R(Q(C+1)) to R(Q(B)). The information concerning the high frequency range component, such as the number of quantization bits information, is encoded in duplicates, that is encoded as a first codestring of from W'(C+1) to W'(B) for low sound quality reproduction and a second codestring of from W(C+1) to W(B) for high sound quality reproduction.

If the bitstring shown in FIG. 13 is reproduced by the decoding device shown in FIG. 8, the decoding device judges that no bit has been allocated to the band (C+1) to the band B and reproduces the bitstring on the assumption that there is no codestring of from R(Q(C+1)) to R(Q(B)), so that the disagreeable noise such as that produced in the example of FIG. 12 is not produced but only an output sound with a narrow band is reproduced. Thus the test viewer can tentatively view the sound of not high quality without feeling disagreeable in order to judge whether or not the key should be purchased.

Figure 14:
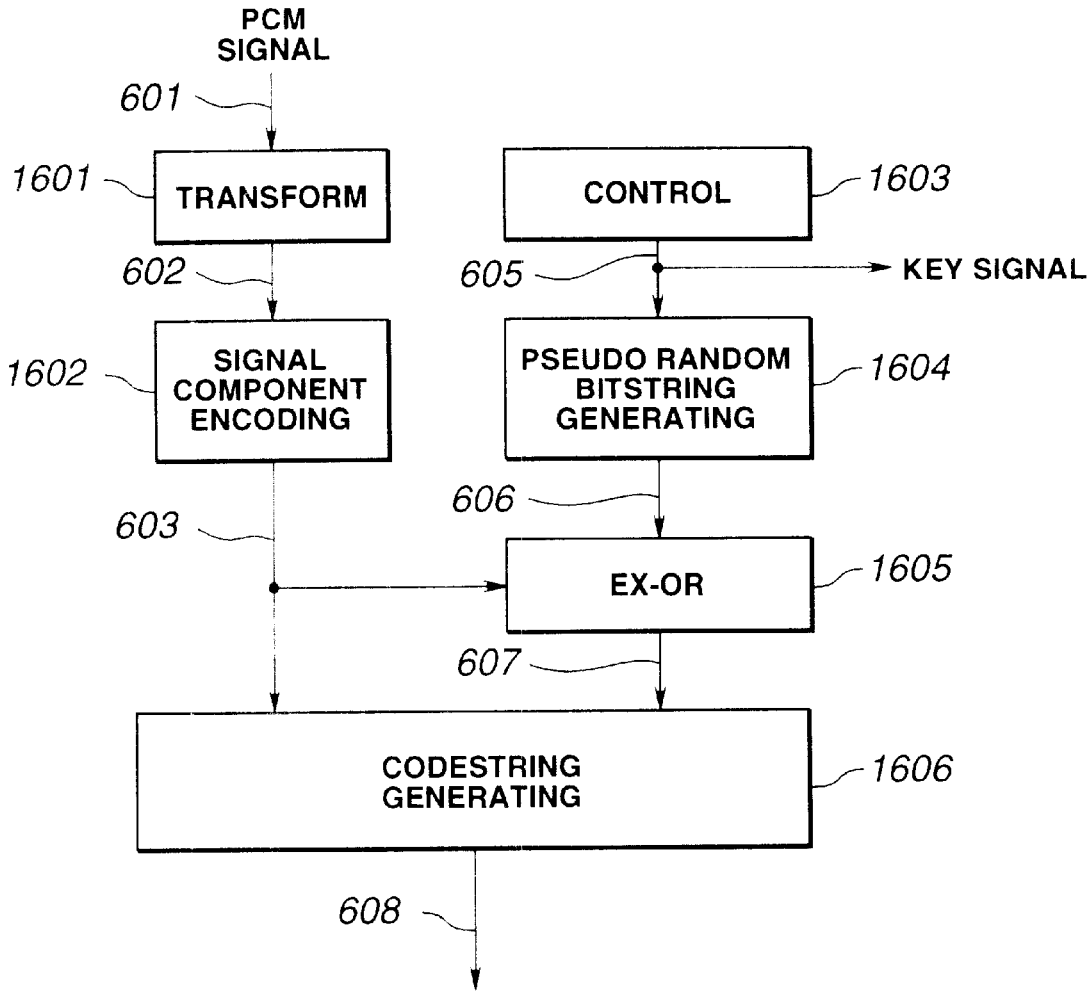
FIG. 14 is a block diagram showing an example of an encoding device according to an embodiment of the present invention.

FIG. 14 shows a specified example of encoding means for carrying out the encoding method of an embodiment of FIG. 13. It is assumed that, in the present specified example, the signal encoded using N bits per time block have been recorded on the recording medium.

In the embodiment shown in FIG. 14, an input PCM signal 601 is converted by a transform unit 1601 into a signal 602 of signal frequency components. This signal is then normalized and quantized by a signal component encoding means 1602 from one pre-set band to another for encoding. In the encoding device shown in FIG. 5, bit allocation is carried out so that M1 bits and M2 bits are used for encoding the numbers of quantization bits and for quantizing the normalization coefficients and so that (N−(M1+M2)*B) bits can be used in a bitstring of the normalized and quantized spectral coefficients for each time block. On the other hand, in the encoding unit shown in FIG. 14, bit allocation is carried out so that (N−(M1+M2)*B−(B−C)*M1) bits can be used in a bitstring of the spectral coefficients normalized and quantized for each time block. The result is outputted as a signal 603 as W(1) to W(B), S(1) to S(B) and Q(1) to Q(B).

Also, a pseudo random bitstring 606 outputted by a pseudo random bitstring generating unit 1604 using a key signal 605 generated by a control unit 1603 as an initial value, is Ex-ORed with a signal 603 outputted by the signal component encoding unit 1602 by an Ex-OR gate 1605, and the resulting Ex-ORed signal is outputted as a signal 607. The codestring generating unit 1606 selectively combines the information of the signals 603, 607 and a 0-signal corresponding to W'(C+1) to W'(B) to output a codestring 608 shown in FIG. 13.

Figure 15:
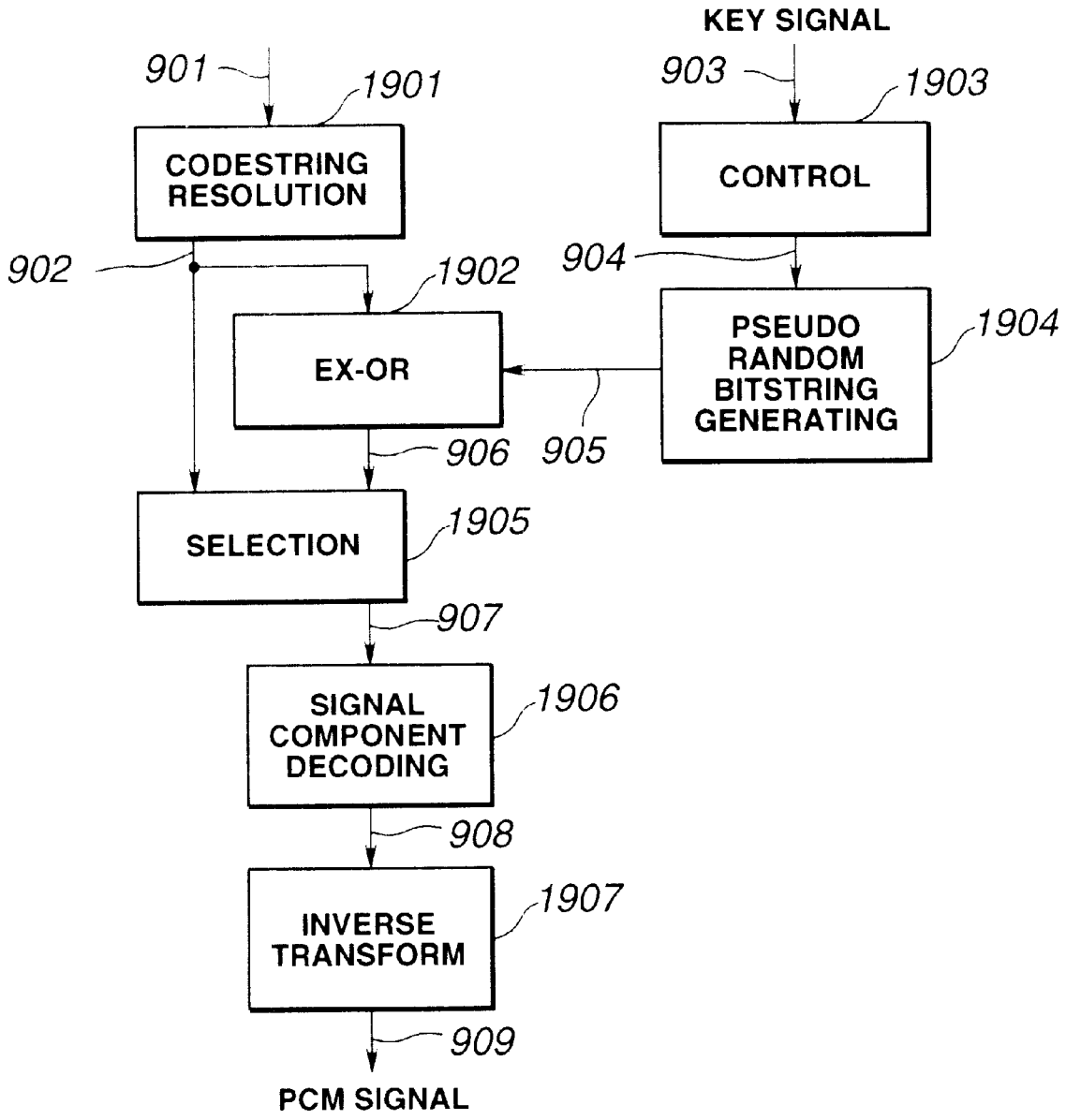
FIG. 15 is a block diagram showing an example of a decoding device according to an embodiment of the present invention.

FIG. 15 shows an illustrative example of a decoding device for high sound quality reproduction of the codestring generated by the encoding device shown in FIG. 14. In this figure, a codestring resolution unit 1901 extracts W(1) to W(B), S(1) to S(B), Q(1) to Q(C) and R(Q(C+1)) to R(Q(B)), from a codestring 901 of the format of FIG. 13, to send the extracted signal to a selection unit 1905 and an Ex-OR gate 1902. On the other hand, the pseudo random bitstring generating unit 1904 generates a pseudo random bitstring 905, which is the same as the signal 606 of FIG. 14, using the key signal 904 sent via control unit 1903, to send the bitstring to the Ex-OR gate 1902. The Ex-OR gate 1902 takes an Ex-OR of the signals 902 and 905 to route the resulting signal 906 to a selection unit 1905.

The selection unit 1905 substitutes Q(C+1) to Q(B) contained in the signal 906 for R(Q(C+1)) to R(Q(B)) in the signal 902 and sends the resulting signal 907 to the signal component encoding unit 1906.

The above-described processing refers to a case in which the key signal has been acquired. If the key signal has not been acquired, the selection unit 1905 disregards R(Q(C+1)) to R(Q(B)) in the signal 902 and sends, in its stead, 0-signal to the signal component encoding unit 1906. The signal component encoding unit 1906 and the back-conversion unit 1907 generate and output a PCM signal 909, as in the case of the decoding unit of FIG. 8.

It will be seen from the foregoing that, if the method described above is used, there is produced no noise on reproduction by a usual decoding unit of FIG. 8 or on reproduction by a decoding unit of FIG. 15, so that the listener does not feel not disagreeable. However, the signal is reproduced with a narrow playback range with a lower sound intensity. If the key is acquired and signal is reproduced by a decoding device of FIG. 15, the signal is reproduced with a broad range of reproduction.

Meanwhile, the encoding method shown in FIG. 13 is merely illustrative of the present invention. For example, W(C+1) to W(B) can be encrypted instead of encrypting Q(C+1) to Q(B) for achieving the result comparable to that in case of encoding by the method of FIG. 13.

Figure 16:
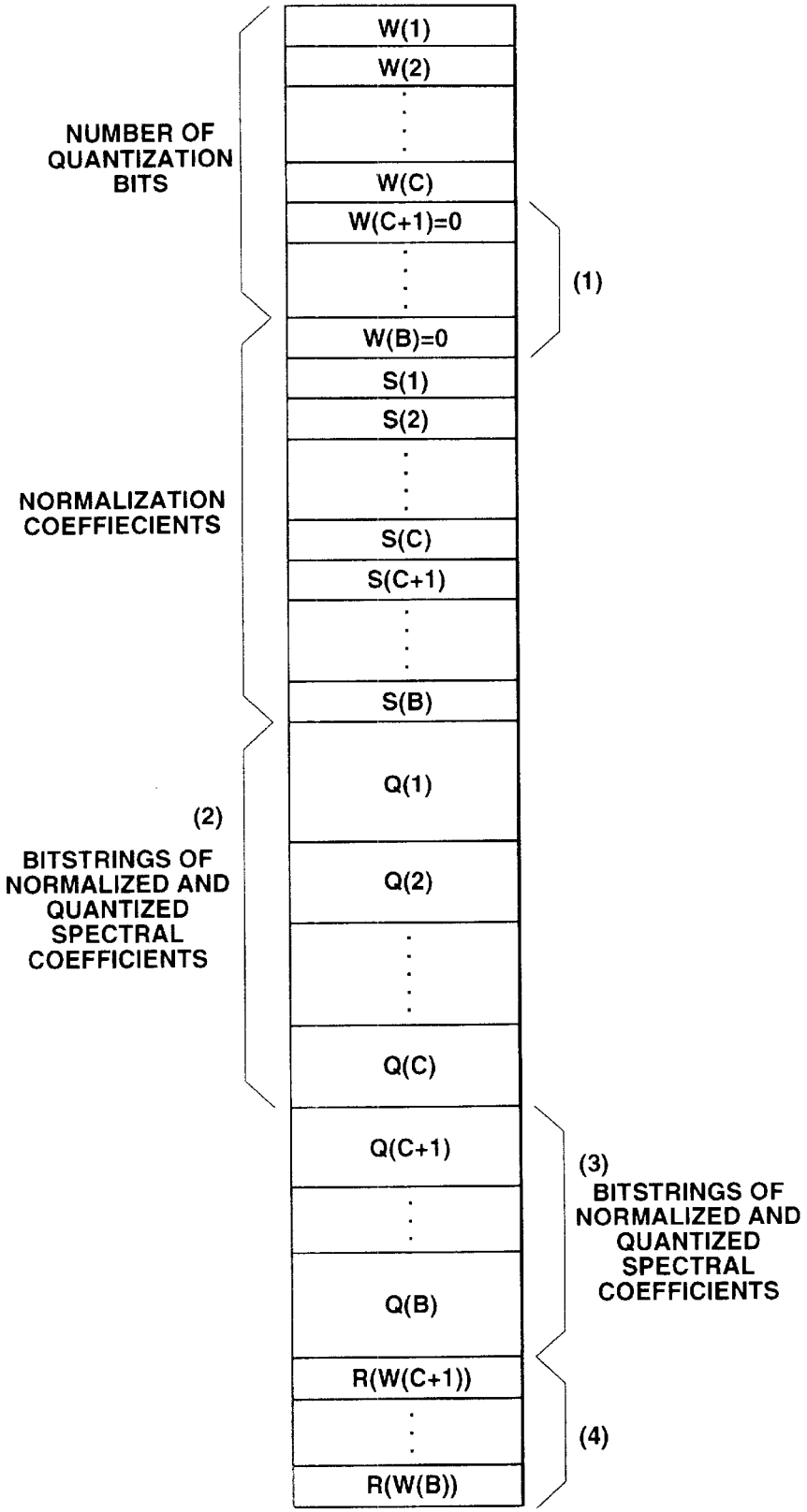
FIG. 16 illustrates an example of a codestring obtained by a modification of the encoding method shown in FIG. 13.
Figure 17:
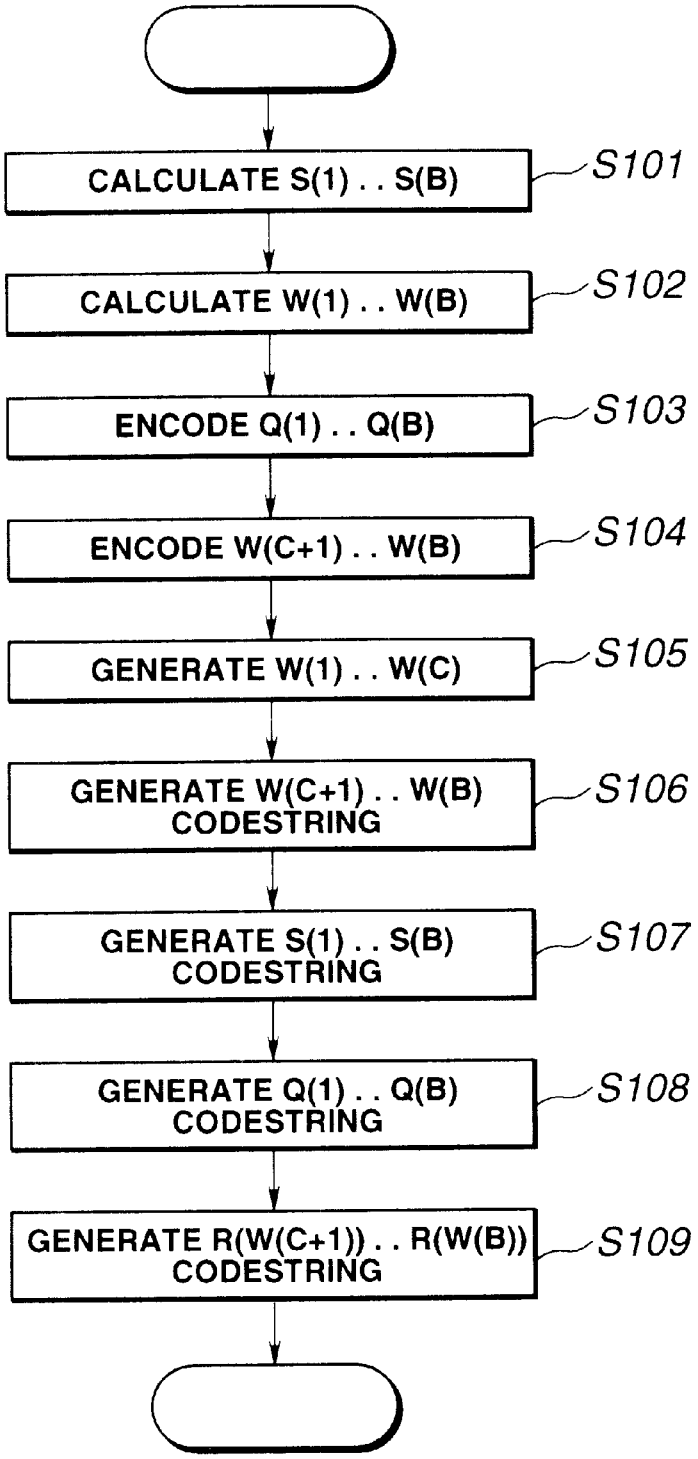
FIG. 17 is a flowchart for illustrating an example of an encoding method for obtaining the codestring shown in FIG. 16.

FIG. 17 shows a flowchart showing an example of processing flow for encoding by the method of FIG. 16. In the processing from step S101 to step S103, the information of S(1) to S(B), W(1) to W(B) and Q(1) to Q(B) is calculated. Then, at step S104, the information of W(C+1) to W(B) and Q(1) to Q(B) is encrypted to produce R(W(C+1)) to R(W(B)). At steps S105 to S109, these are combined together to generate a codestring of FIG. 16.

Figure 18:
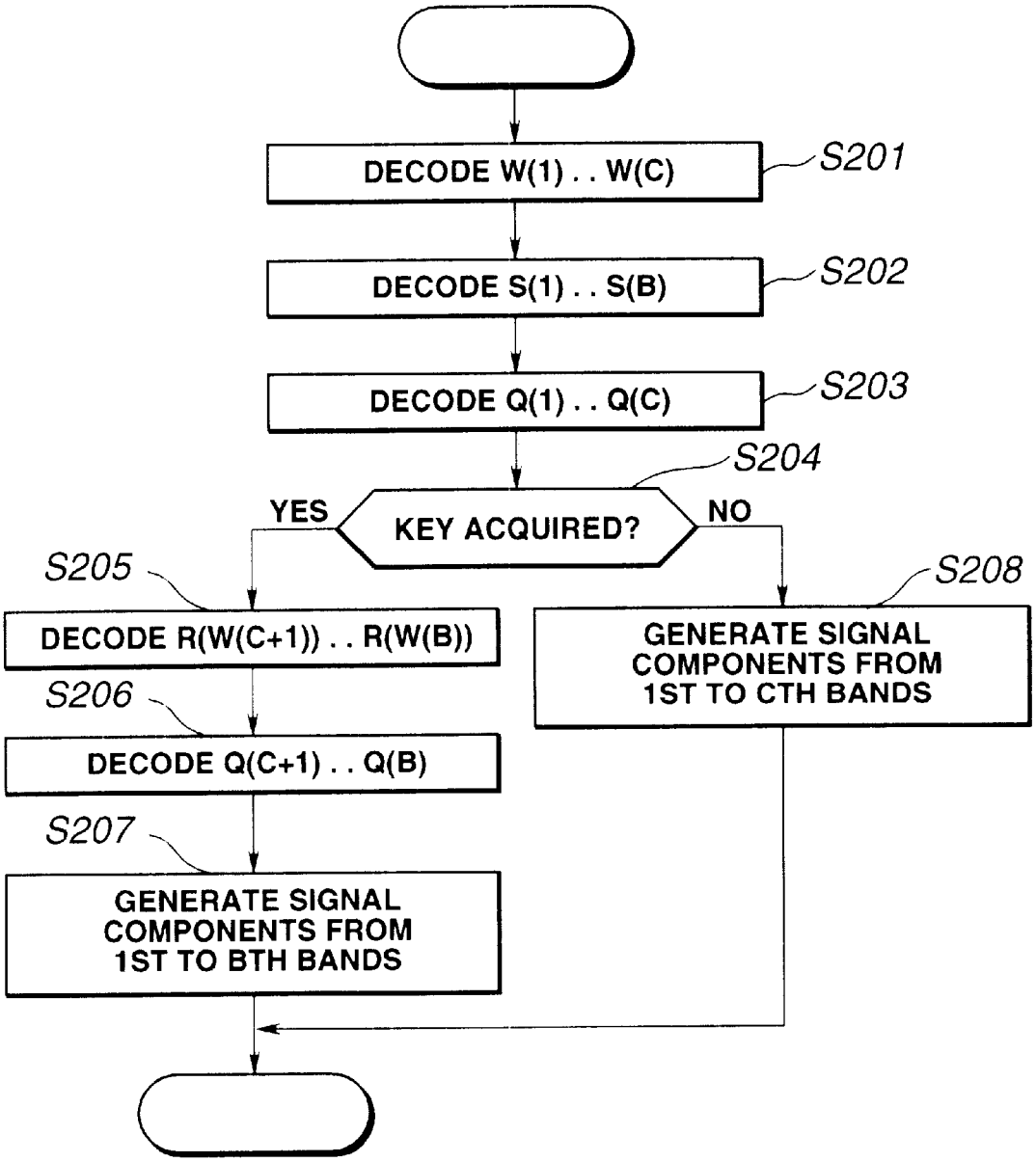
FIG. 18 is a flowchart for illustrating an example of a decoding method for decoding the codestring shown in FIG. 16 and a decoding method of the present invention.

FIG. 18 shows an example of processing flow for generating signal components of a band to be reproduced from the codestring of FIG. 16. First, at step S201, the bit number information W(C) is decoded from the low frequency range side number of quantization bits information W(1). Then, at step S202, the normalization coefficients of the entire ranges S(1) to S(B) are decoded. At step S203, the normalized and quantized spectral components on the low frequency range side Q(1) to Q(C) are decoded. Then, at step S204, it is checked whether or not the key has been acquired. If the key has been acquired, processing transfers to step S205. At step S205, the number of quantization bits information R(W(C+1)) to R(W(B)) on the high frequency range side is decoded using the key. At step S206, W(C+1) to W(B) thus acquired is used to decode the information Q(C+1) to Q(B). Using the information, thus acquired, the first to Bth signal components are generated at step S207. If the key has not been acquired, only low frequency range side first to Cth signal components are generated at step S208.

In the foregoing, alternative embodiments for encoding in accordance with the present invention have been explained. However, there are various other methods for carrying out the present invention. For example, if normalization coefficients of extremely small values can be encoded, the extremely small normalization coefficients values may be recorded at the positions in which the high frequency range side normalization coefficients are judged to be recorded by the decoding unit of FIG. 8, while true normalization coefficients are recorded separately. If the signal is reproduced by usual decoding device shown in FIG. 8, or without acquiring the key, the listener does not feel disagreeable since there is produced substantially no noise, but the signal is reproduced with a low signal intensity with a narrow playback range. If the signal is reproduced with an acquired key, the signal is reproduced with a high signal quality.

Similarly, if the number of encoded bands is also recorded, the information representing a narrow band can be recorded at a position the decoding unit of FIG. 8 judges to be the position of recording of the information, with the true number of bands information being then recorded in other positions. In addition, various other methods of recording part of the codes in multiplex may be envisaged in which high quality reproduction is possible only with the use of one of the signals and only part of the signals can be reproduced otherwise. These alternative methods are also comprised within the methods of the present invention.

Figure 19:
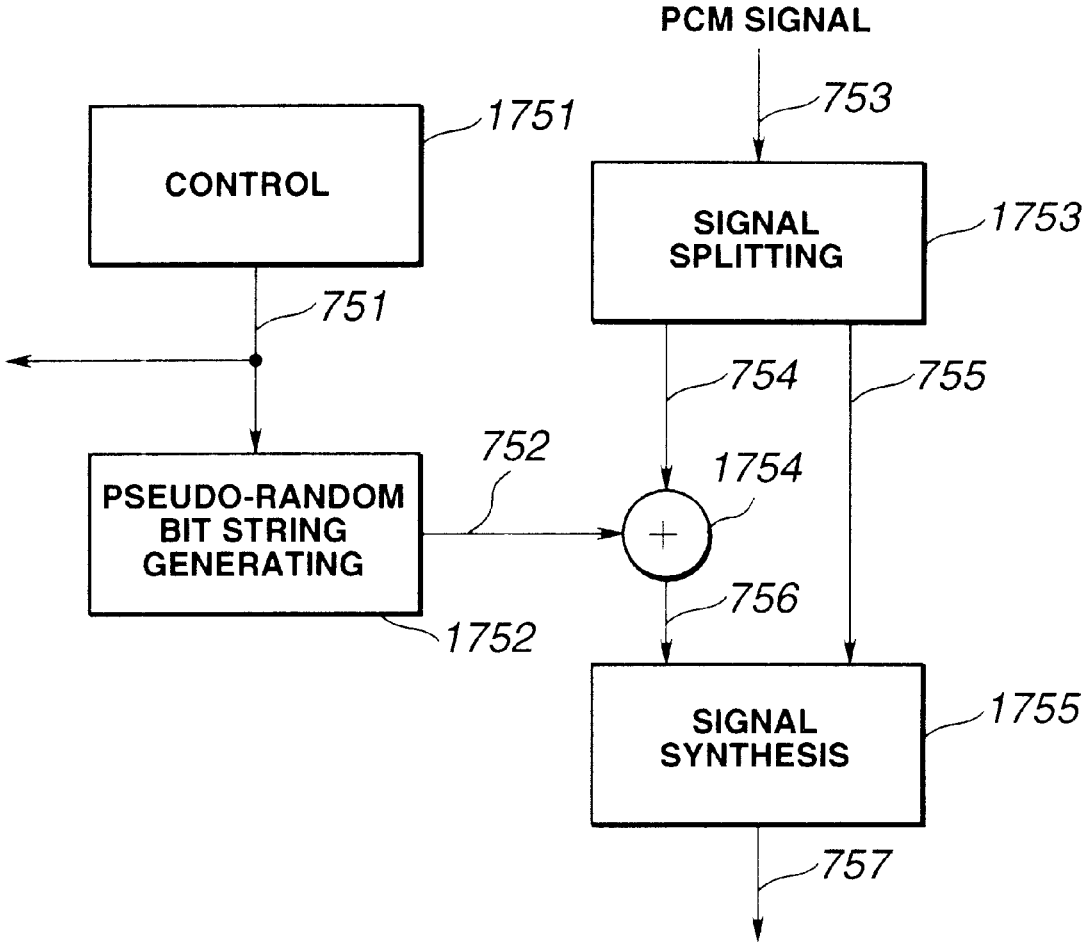
FIG. 19 is a block diagram showing an encoding device according to a further embodiment of the present invention.
Figure 20:
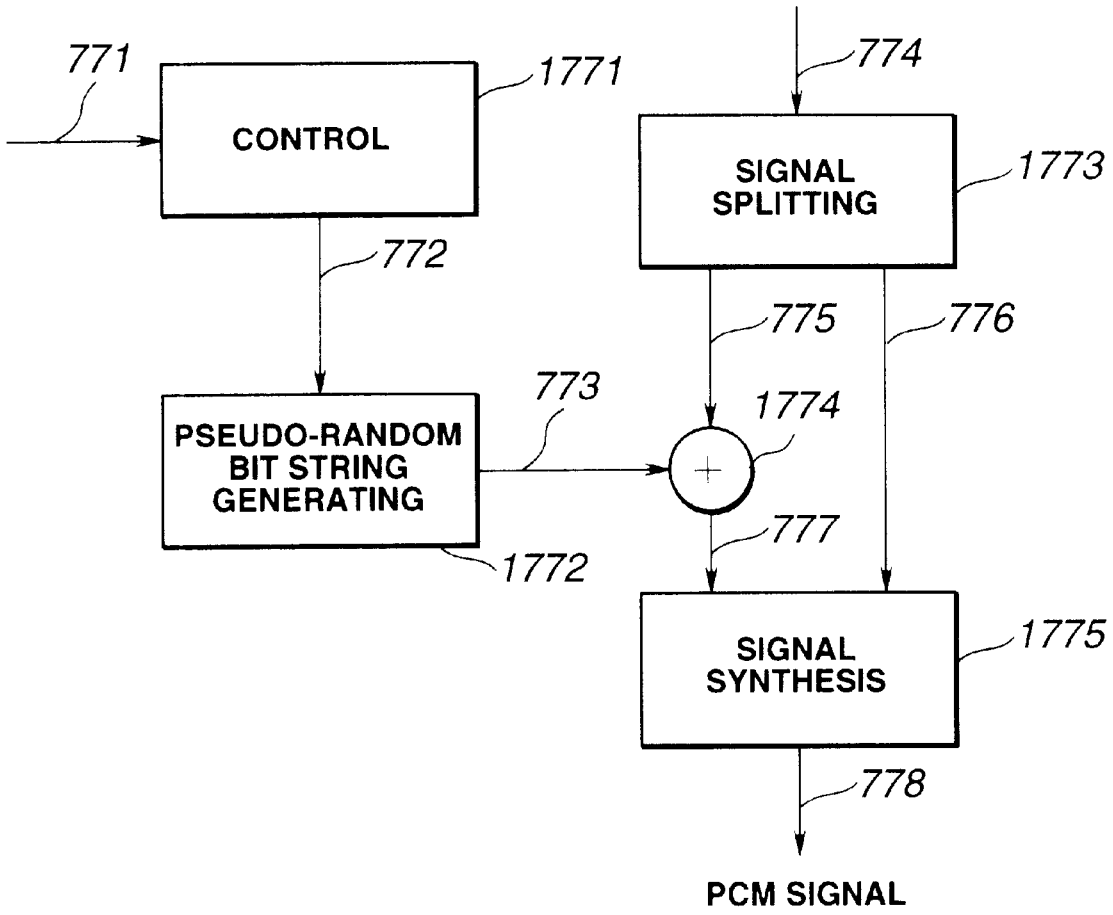
FIG. 20 is a block diagram showing a decoding device according to a further embodiment of the present invention.

Although the method has been described above in which the signal is split along the frequency axis and is encrypted partially, the signal can also be split in the level direction and encrypted partially. FIGS. 19 and 20 show the configurations of the encoding and decoding units for the latter case, respectively.

Referring to FIG. 19, an input PCM signal 753 is split by a signal splitting unit 1753 into lower side bits 754 and upper side bits 755 and only the lower side bits 754 are scrambled by an Ex-OR unit 1754 and again synthesized with the upperside bits by a signal synthesis unit 1755. Referring to FIG. 20, a bitstring 774, which is the same as an output 757 of the encoding unit of FIG. 19, is split into lower side bits 775 and upper side bits 776, and only the lower side bits 775 are descrambled by an Ex-OR gate 1774 so as to be synthesized again with the upper side bits by the signal synthesis unit 1775 to produce a PCM signal 778 which is the same as the input PCM signal of FIG. 19.

If the signal is split along the frequency axis, there is heard no noise and only little extraneous feeling is invoked if the signal is heard in the unscrambled state. If the signal is compressed, the information of the lower side bits tends to be erased. Thus, splitting the signal in the frequency axis direction is more versatile in usage.

Although the foregoing description has been directed to audio signals, the present invention is similarly applicable to image signals. However, for audio signals, adaptive bit allocation on the band basis is particularly effective for maintaining high sound quality, such that a method for recording the bit allocation information is widely used for this purpose. Thus, the method of the present invention can be applied easily and effectively.

Although the method of encrypting the signal by the key information is adapted to each music number, the present invention is applicable to a case of not using the key information adapted to each music number, such that it is also possible to encode the information necessary for high sound quality reproduction by a confidential common algorithm. In this case, the standard for high sound quality reproduction itself acts as a key. This case is encompassed in the meaning of encryption in the description of the present invention. Of course, if the key information is used from one musical number to another or from one recording medium to another for management, the information circulation processing may become safer.

Although the recording of an encoded bitstream on a recording medium has been described in the foregoing, the method of the present invention is also applicable to transmission of the bitstream. In the latter case, the audio signal in air can be reproduced with high sound quality by a listener who has acquired the key, while the contents of the signals can be barely comprehended but only reproduction with low sound quality is enabled by other listeners.

What is claimed is:

1. A method of encoding an audio signal, comprising the steps of:

splitting the audio signal into a first signal component for permitting only comprehension of its contents and a second signal component for high quality reproduction; and encrypting and encoding only said second signal component.

2. The method as claimed in claim 1, wherein said first signal component is a low frequency component of said audio signal and said second signal component is a high frequency component of said audio signal.

3. The method as claimed in claim 1, wherein said encoding encodes the second signal component by compression.

4. The method as claimed in claim 1, further comprising the step of:

encoding said first signal component into a first code for low quality reproduction, wherein said first code is not encrypted and said first code is encoded in duplex with the encoding of said second signal component.

5. The method as claimed in claim 1, wherein said audio signal is an acoustic signal.

6. A recording medium having an encoded digital signal recorded thereon, the recording medium being prepared by the steps of:

splitting an audio signal into a first signal component for permitting only comprehension of the signal contents and a second signal component for high quality reproduction;

encrypting and encoding only the second signal component; and recording the first signal component and the encrypted encoded second signal component on the recording medium.

7. The recording medium as claimed in claim 6, wherein said first signal component is a low frequency component of said audio signal and said second signal component is a high frequency component of said audio signal.

8. The recording medium as claimed in claim 6, wherein said encoding encodes the second signal component by compression.

9. The recording medium as claimed in claim 6, further comprising the step of:

encoding said first signal component into a first code for low quality reproduction, wherein said first code is not encrypted and said first code is encoded in duplex with the encoding of said second signal component.

10. The recording medium as claimed in claim 6, wherein said audio signal is an acoustic signal.

11. A decoding apparatus for decoding an encoded audio signal, comprising:

means for splitting the encoded audio signal into a first signal component of low quality permitting only comprehension of the signal contents and into a second signal component for high quality reproduction; and means for selecting whether or not the second signal component should be decoded depending upon a presence or absence of a key signal for encryption.

12. The decoding apparatus as claimed in claim 11, wherein said first signal component is a low frequency component of said encoded audio signal and said second signal component is a high frequency component of said encoded audio signal.

13. The decoding apparatus as claimed in claim 11, wherein said encoded audio signal comprises a second signal component encoded by compression.

14. The decoding apparatus as claimed in claim 11, wherein said encoded audio signal comprises an audio signal which is encoded into a first code for low quality reproduction and a second code for high quality reproduction, wherein said first code is not encrypted.

15. The decoding apparatus as claimed in claim 11, wherein said encoded audio signal is an encoded acoustic signal.

16. An apparatus for encoding an audio signal, comprising:

means for splitting the audio signal into a first signal component for permitting only comprehension of its contents and a second signal component for high quality reproduction; and means for encrypting and encoding only said second signal component.

17. The apparatus as claimed in claim 16, wherein said first signal component is a low frequency component of said audio signal and said second signal component is a high frequency component of said audio signal.

18. The apparatus as claimed in claim 16, wherein said encoding encodes the second signal component by compression.

19. The apparatus as claimed in claim 16, further comprising:

means for encoding said first signal component into a first code for low quality reproduction, wherein said first code is not encrypted and said first code is encoded in duplex with the encoding of said second signal component.

20. The apparatus as claimed in claim 16, wherein said audio signal is an acoustic signal.

21. A method of transmitting an audio signal, comprising the steps of:

splitting the audio signal into a first signal component for permitting only comprehension of the signal contents and a second signal component for high quality reproduction;

encrypting and encoding only the second signal component; and transmitting the first signal component and the encrypted encoded second signal component.

22. The method as claimed in claim 21, wherein said first signal component is a low frequency component of said audio signal and said second signal component is a high frequency component of said audio signal.

23. The method as claimed in claim 21, wherein said encoding encodes the second signal component by compression.

24. The method claimed in claim 21, further comprising the step of:

encoding said first signal component into a first code for low quality reproduction, wherein said first code is not encrypted and said first code is encoded in duplex with the encoding of said second signal component.

25. The method as claimed in claim 21, wherein said audio signal is an acoustic signal.

26. A method of decoding an encoded audio signal, comprising the steps of:

splitting the encoded audio signal into a first signal component of low quality permitting only comprehension of the signal contents and into a second signal component for high quality reproduction; and selecting whether or not the second signal component should be decoded depending upon a presence or absence of a key signal for encryption.

27. The method as claimed in claim 26, wherein said first signal component is a low frequency component of said encoded audio signal and said second signal component is a high frequency component of said encoded audio signal.

28. The method as claimed in claim 26, wherein said encoded audio signal comprises a second signal component encoded by compression.

29. The method as claimed in claim 26, wherein said encoded audio signal comprises an audio signal which is encoded into a first code for low quality reproduction and a second code for high quality reproduction, wherein said first code is not encrypted.

30. The method as claimed in claim 26, wherein said encoded audio signal is an encoded acoustic signal.

* * * * *